US009776228B2

(12) United States Patent
Rauffmann et al.

(10) Patent No.: US 9,776,228 B2
(45) Date of Patent: Oct. 3, 2017

(54) PILGER ROLLING TRAIN

(71) Applicant: Sandvik Materials Technology Deutschland GmbH, Düsseldorf (DE)

(72) Inventors: Udo Rauffmann, Werther (DE); Thomas Froböse, Versmold (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 0 days.

(21) Appl. No.: 14/426,403

(22) PCT Filed: Sep. 13, 2013

(86) PCT No.: PCT/EP2013/069023

§ 371 (c)(1),
(2) Date: Mar. 6, 2015

(87) PCT Pub. No.: WO2014/041127

PCT Pub. Date: Mar. 20, 2014

(65) Prior Publication Data

US 2015/0258590 A1 Sep. 17, 2015

(30) Foreign Application Priority Data

Sep. 14, 2012 (DE) ..... 10 2012 108 643

(51) Int. Cl.
*B21B 21/00* (2006.01)
*B21B 21/04* (2006.01)
(Continued)

(52) U.S. Cl.
CPC ..... *B21B 21/04* (2013.01); *B21B 21/00* (2013.01); *B21B 37/78* (2013.01); *B21B 39/00* (2013.01);
(Continued)

(58) Field of Classification Search
CPC ..... B21B 17/04; B21B 19/04; B21B 21/00; B21B 21/04; B21B 37/78; B21B 39/00;
(Continued)

(56) References Cited

U.S. PATENT DOCUMENTS 1,617,936 A * 2/1927 Bamberger ..... B21B 23/00 72/200
1,772,065 A 8/1930 Bangert
(Continued)

FOREIGN PATENT DOCUMENTS

CN 101890432 A * 11/2010 ..... B21B 23/00
CN 101956137 A * 1/2011 ..... B21B 23/00
(Continued)

OTHER PUBLICATIONS

Translation of JP2003-342761A, Dec. 3, 2003.*
(Continued)

*Primary Examiner* — Edward Tolan
(74) *Attorney, Agent, or Firm* — Morgan, Lewis & Bockius LLP

(57) ABSTRACT

Pilger rolling train, which operates continuously for producing a tube, includes a pilger rolling mill for reducing the diameter of a hollow blank to form the tube, a first buffer for a plurality of tubes, wherein the first buffer has a device for bundling a plurality of tubes in a bundle, an annealing furnace for simultaneous annealing of a plurality of tubes, a second buffer for a plurality of tubes, wherein the second buffer for the tubes has a device for separating the plurality of tubes out of a bundle, and a straightening machine for straightening the separated tubes in succession, wherein the devices are disposed, in the direction of flow of the tube, in the aforementioned sequence, and wherein an automated transport device for the tube is provided between, respec-
(Continued)

tively, the pilger rolling mill, the first buffer, the annealing furnace, the second buffer and the straightening machine.

16 Claims, 1 Drawing Sheet

(51) Int. Cl.

| | |
|---|---|
| ***B21B 39/00*** | (2006.01) |
| ***B21B 37/78*** | (2006.01) |
| ***B21D 3/00*** | (2006.01) |
| ***C21D 9/00*** | (2006.01) |
| *B21B 45/00* | (2006.01) |

(52) U.S. Cl.
CPC ..... *B21B 39/002* (2013.01); *B21B 45/004* (2013.01); *B21D 3/00* (2013.01); *C21D 9/0006* (2013.01); *B21B 2045/006* (2013.01)

(58) Field of Classification Search
CPC . B21B 39/002; B21B 45/004; B21B 45/0278; B21B 23/00; B21B 45/02; B21B 21/06; C21D 9/08; C21D 9/0006; C21D 9/0018
See application file for complete search history.

(56) References Cited

U.S. PATENT DOCUMENTS

| | | | | | |
|---|---|---|---|---|---|
| 1,970,570 | A * | 8/1934 | Littler | B21B 23/00 | 29/33 R |
| 1,971,829 | A * | 8/1934 | Osborne | B21B 23/00 | 266/160 |
| 1,983,934 | A * | 12/1934 | Devine | B21B 23/00 | 72/69 |
| 2,023,776 | A | 12/1935 | Wefing | | |
| 3,234,055 | A * | 2/1966 | Feng | C22F 1/00 | 148/712 |
| 4,452,061 | A | 6/1984 | Numano et al. | | |
| 5,141,379 | A | 8/1992 | Warga | | |
| 2005/0191509 | A1 * | 9/2005 | Nakashima | B21D 3/04 | 428/610 |
| 2009/0064749 | A1 * | 3/2009 | Hidaka | C22C 38/58 | 72/208 |
| 2010/0037976 | A1 * | 2/2010 | Toyotake | B21C 23/007 | 138/177 |
| 2010/0308612 | A1 * | 12/2010 | Antunes | B21J 5/08 | 295/36.1 |

FOREIGN PATENT DOCUMENTS

| | | | | | |
|---|---|---|---|---|---|
| DE | 1952180 | A1 | | 4/1971 | |
| DE | 3042538 | A1 | | 7/1982 | |
| DE | 3149647 | A1 | | 8/1982 | |
| DE | 4008979 | C1 | | 8/1991 | |
| DE | 10261632 | B4 | | 9/2004 | |
| GB | 687283 | A | * | 2/1953 | B21B 19/02 |
| GB | 1296259 | | | 11/1972 | |
| JP | 61-159214 | | | 7/1986 | |
| JP | H04-154944 | A | | 5/1992 | |
| JP | 6-256789 | A | * | 9/1994 | B21B 21/00 |
| JP | 2003-342761 | A | * | 12/2003 | B21B 21/00 |
| WO | 2011/030273 | A2 | | 3/2011 | |

OTHER PUBLICATIONS

Machine Translation, JP 61-159214, Jul. 1986.*
Rashnikov et al., "Radical Reconstruction of Bar Production at OAO MMK", Steel in Translation, vol. 37, No. 2, pp. 152-157, 2007.
International Search Report and Written Opinion dated Feb. 7, 2014 for PCT/EP2013/069023.
German Search Report in 10 2012 108 643.5 dated Jul. 17, 2013.
International Preliminary Report on Patentability dated Mar. 17, 2015, for the corresponding International application No. PCT/EP2013/069023.
Notice of Reasons for Rejection (with English translation) for Japanese Application No. 2015-531573 dated Sep. 6, 2016.

* cited by examiner

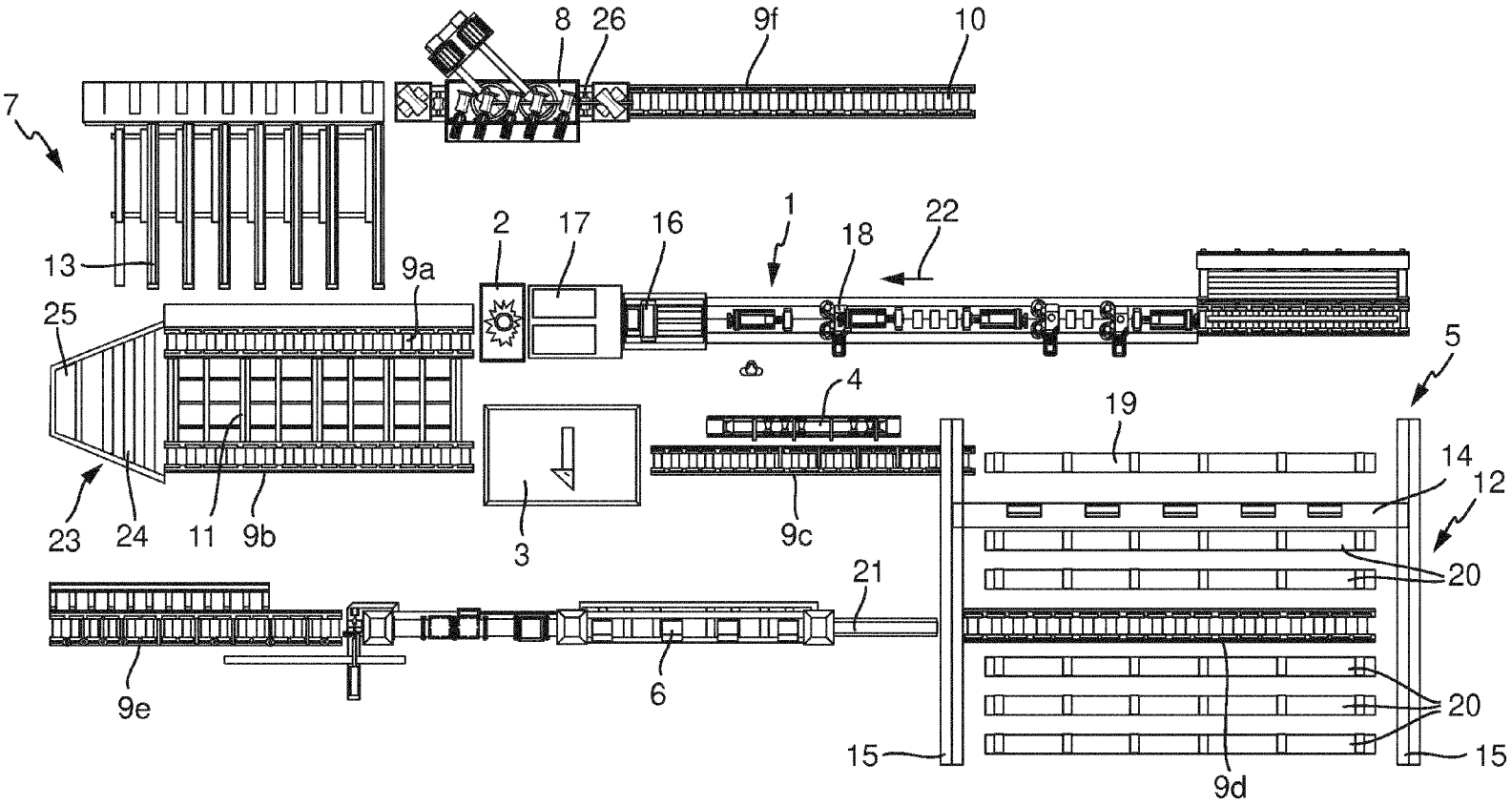
5
14
12
20
20
15
9d
19
10
22
18
4
21
15
9f
1
9c
16
6
26
8
17
3
2
9a
9b
11
24
9e
13
25
23
7

PILGER ROLLING TRAIN

RELATED APPLICATIONS

The present application is a U.S. National Phase Application of International Application No. PCT/EP2013/069023, filed 13 Sep. 2013, which claims priority to German Application No. 10 2012 108 643.5, filed 14 Sep. 2012.

The present invention relates to a rolling train for producing a tube, comprising a pilger rolling mill for reducing the diameter of a hollow blank to form a tube.

For the purpose of producing precise metal tubes, particularly of special steel, an extended blank in the form of a hollow cylinder, in a completely cooled state, undergoes a process of cold reduction by compressive stresses. In this process, the blank is transformed into a tube having a defined, reduced external diameter and a defined wall thickness.

The most widespread reducing method for tubes is known as cold pilgering, wherein the blank is referred to as a hollow blank. In the rolling process, the hollow blank is pushed over a calibrated rolling mandrel, i.e. a mandrel having the internal diameter of the finished tube, and is encompassed from the outside by two calibrated rollers, i.e. rollers that define the external diameter of the finished tube, and rolled out in the longitudinal direction over the rolling mandrel.

In production, following rolling, the ready rolled-out tubes must undergo a number of further processing steps. In particular, it is necessary to anneal the ready rolled tubes, for the purpose of hardening. In the annealing process, a plurality of bundled tubes are inserted into a furnace and annealed therein at the necessary temperatures.

The process steps of rolling in the pilger rolling mill and annealing in the furnace are separated from each other in time, and the ready rolled tubes are first bundled, stored as a bundle and, considerably later in time, annealed in a closed furnace. Because of this procedure, referred to as bundle production, the production of a tube, from reduction by the pilger rolling mill to packaging, takes approximately two weeks, wherein the actual processing within these two weeks takes only approximately two hours.

In comparison with this, the object of the present invention is to provide a rolling train that operates continuously.

Proposed for this purpose, according to the invention, is a pilger rolling train for producing a tube, comprising a pilger rolling mill for reducing the diameter of a hollow blank to form the tube, a first buffer for a plurality of tubes, wherein the first buffer has a device for bundling a plurality of tubes in a bundle, an annealing furnace for simultaneous annealing of a plurality of tubes, a second buffer for a plurality of tubes, wherein the second buffer for the tubes has a device for separating the plurality of tubes out of a bundle, and a straightening machine for straightening the separated tubes in succession, wherein the devices are disposed, in the direction of flow of the tube, in the aforementioned sequence, and wherein an automated transport device for the tube is provided between, respectively, the pilger rolling mill, the first buffer, the annealing furnace, the second buffer and the straightening machine.

Crucial for the rolling train according to the invention is that it operates continuously, i.e. preferably in the charged state, a hollow blank is rolled out in the pilger rolling mill while, substantially simultaneously, at the end of the rolling train, after the straightening machine, a finished tube can be removed from the train and packaged.

For the continuous processing of tubes in the rolling train according to the invention, it is necessary for the latter to have, between the individual devices, i.e., for example, between the pilger rolling mill and the first buffer, a transport device that moves the tube in an automated manner between the individual processing stations.

In one embodiment of the invention, the rolling train has a control system, which makes it possible to control the entire production process in the rolling train and thus to operate the latter in an automated manner.

Consideration of the necessary processing times in the central processing device of the rolling train, namely, the pilger rolling mill, the annealing furnace and the straightening machine, reveals the following situation: the transport speed of the rolled tubes in the furnace is significantly slower than the transport speed of the hollow blank, or of the tube, during pilgering in the rolling mill. Likewise, the transport speed of the rolled tubes through the furnace is significantly slower than the transport speed of the tube in the straightening machine. Unlike the case of the rolling mill and the straightening machine, however, a plurality of tubes can be annealed at once in the furnace, depending on the size of the tubes to be annealed. In this case, the greater the mass of an individual tube portion to be annealed, the fewer the tube portions of the same length that can be annealed.

In order to be able to compensate for the differing processing periods, in the annealing furnace on the one hand and, on the other hand in the rolling mill and in the straightening machine, the two buffers constitute a central element of the rolling train.

The two buffers are not merely used for storage, but rather in the buffers a plurality of tubes are optionally bundled together to form a bundle (first buffer), and a plurality of tubes are optionally separated out from a bundle (second buffer).

A bundle of tubes, or tube portions, within the meaning of the present application, is understood to mean a number of tubes that together constitute a furnace charge, i.e. that are simultaneously passed into and through the furnace and annealed.

Such a bundle may be, but need not be, bound together by means of tie wires. In one embodiment, such binding together is optionally effected in an automated manner.

Also understood as a bundle, within the meaning of the present application, is a plurality of tubes that are not bound together. In this sense, a device for bundling the tubes is then, for example, a common storage bench for a plurality of tubes, which are then delivered jointly to the furnace.

For the purpose of explanation, two extreme cases are considered in the following: of a thick-walled tube of large internal diameter, which has a correspondingly large mass, only a single tube portion can be annealed in the furnace, which has a fixed maximum of mass that can be annealed simultaneously. Since the transport speed is significantly slower than the transport speed of the rolling mill, the tube portions subsequently pilgered in the rolling mill accumulate, and must be stored in the first buffer until they can be successively annealed. The second buffer, by contrast, is empty in this situation, since the tube portions that exit the furnace undergo further processing at a speed that is greater than the transport speed of the furnace.

Of a thin-walled tube having a small internal diameter, by contrast, a plurality of tube portions can be annealed simultaneously in the furnace. In this case, for instance, so many tube portions can be annealed simultaneously that their total mass corresponds to the mass of a single tube portion having dimensions that are the maximum that can be annealed in the furnace. In this case, the individual ready pilgered and cut-off tube portions are collected in the first buffer, until the maximum number of tubes that can be annealed in one furnace charge has been attained, and are then inserted jointly into the furnace. After the oven in this case, intermediate storage is effected in the second buffer, in order to separate the tube portions that exit the furnace simultaneously, and to deliver them individually to the straightening machine.

An expedient embodiment of the first buffer allows tubes or tube portions already pilgered in the rolling train to be extracted from the rolling train at this location, and/or tubes or tube portions pilgered at a different point in time and/or on another rolling mill to be fed into the rolling train for further processing at this location.

In one embodiment of the invention, the transport direction of the hollow blank in the pilger mill defines a first direction, wherein the first buffer has a transport device for transporting the tubes in a second direction that is perpendicular to the first direction. This transport in a direction perpendicular to the transport direction of the hollow blank in the rolling mill makes it possible, on the one hand, for the individual tubes that have exited the rolling mill to be bundled, and for the tubes to be intermediately stored, or buffered, before being fed in the bundle into the furnace. On the other hand, the transport device in a direction perpendicular to the transport direction of the hollow blank in the pilger rolling mill also makes it possible to turn around the transport direction of the tube in the mill.

In one embodiment of the invention, it is expedient if the rolling train is set up such that the tube in the rolling train is also transported, portionally, in a direction that is parallel but opposite to the first direction. In this way the rolling train, which in one embodiment could also be of a linear design, can be folded, with the result that the entire length of the rolling train is divided up in to a plurality of shorter portions. Although this does not reduce the total space requirement of the rolling train, it does nevertheless reduce its overall length, and therefore the length of the building in which the rolling train is accommodated.

For the same reason it is advantageous if, in one embodiment of the invention, the second buffer has a transport device for transporting the tubes in a second direction that is perpendicular to the first direction. In particular, it is expedient if the second buffer overlaps parts of the rolling train, with the result that the tubes cross these parts of the rolling train.

In one embodiment of the invention, the device for bundling a plurality of tubes and/or the device for separating the plurality of tubes from a bundle are/is set up an as to enable automated bundling, or separating, respectively.

In one embodiment of the invention, the pilger rolling mill has a rolling stand, a flywheel on a drive shaft, that is mounted so as to be rotatable about a rotation axis, and a push rod having a first and a second end, wherein the first end of the push rod is attached to the flywheel at a radial distance from the rotation axis, and wherein the second end of the push rod is attached to the rolling stand, with the result that, when the mill is in operation a rotary motion of the flywheel is converted into a translational motion of the rolling stand. Calibrated rollers are rotatably mounted on the rolling stand. The milers preferably obtain their rotary motion by means of a toothed rack, which is fixed relative to the rolling stand and in which there engage toothed wheels that are fixedly connected to the roller axles.

During the pilgering operation, the hollow blank is fed progressively in the direction towards and beyond the rolling mandrel, while the rollers are moved horizontally back and forth over the mandrel, and thus over the hollow blank.

The feeding of the hollow blank over the mandrel is effected by means of a feed clamping carriage that enables a translational motion in a direction parallel to the axis of the rolling mandrel. The linear feed of the feed clamping carriage in the pilger rolling mill is achieved, for example, by means of a ball screw drive. The ball screw drive consists of a servomotor, a transmission, an acme-threaded spindle, the associated bearing points and corresponding lubrication, as well as an acme-threaded spindle nut. The servomotor is connected to the transmission via a clutch, and the transmission is connected to the acme-threaded spindle itself via a further clutch. By means of the acme-threaded spindle nut, the rotary motion of the threaded spindle is converted into a translational motion. In an alternative embodiment, the linear feed of the feed clamping carriage may also be effected by means of a linear drive.

Alternatively, a transmission drive, or also a direct drive via a clutch between the rotation axis of the flywheel and the motor shaft of a torque motor, are available for driving the crank mechanism for the linear motion of the rolling stand.

The conically calibrated rollers, disposed over one another in the rolling stand, rotate contrary to the feed direction of the feed clamping carriage. The so-called pilger mouth formed by the rollers grasps the hollow blank, and the rollers externally squeeze off a small wave of material, which is extended to an assigned wall thickness by the smoothing pass of the rollers and by the rolling mandrel, until the idling pass of the rollers releases the finished tube. During the rolling operation, the rolling stand, with the rollers attached thereto, moves contrary to the feed direction of the hollow blank. The hollow blank, after attaining the idling pass of the rollers, is displaced by a further step towards the rolling mandrel, by means of the feed clamping carriage, while the rollers return with the rolling stand to their initial horizontal position. At the same time, the hollow blank undergoes rotation about its axis, in order to achieve a uniform shape of the finished tube in the circumferential direction. As a result of each tube portion being rolled over multiple times, a uniform wall thickness and roundness of the tube is achieved, as well as a uniform internal and external diameter.

In one embodiment, a floor intake for the ready pilgered tube is provided after the rolling mill, in the outlet region thereof. In the pilger rolling of tubes, hollow blanks are rolled out to form tube portions, to lengths of 20 m and above, with the result that it is often only with difficulty that their full length can be accommodated in a hall. According to the invention, therefore, it is possible to curve the tube slightly after the outlet from the rolling mill, and to allow it to be taken in, for instance, vertically downwards, to the floor of the hall. This saves surface area for the installation in the hall.

In one embodiment of the invention, the annealing furnace is a continuously operating furnace, the muffle of which is kept at a substantially constant temperature. For this purpose, in one embodiment of the invention, the annealing furnace is a belt furnace, preferably a mesh belt furnace. In the case of such a mesh belt furnace, the tubes to be annealed are moved through the furnace, or the muffle thereof, on a metallic belt. For this purpose, the mesh belt furnace has two sluices, through which the tube to be annealed can be moved into or out of the furnace, without the muffle being thereby subjected to significant temperature fluctuations.

In one embodiment, the annealing furnace is set up such that the annealing process is effected in a protective atmosphere, for example in hydrogen, nitrogen or argon. In one embodiment, the annealing temperature of the furnace is between 400° C. and 1300° C., preferably between 1000° C. and 1200° C., and particularly preferably is 1150° C.

In one embodiment, the automated transport devices between the individual processing stations of the rolling train according to the invention are roller conveyors, on which the tube can be moved in the longitudinal direction. For this purpose, in one embodiment, one or more rollers of the roller conveyor is motor-driven.

However, the transport devices between the individual processing stations may also be gripper facilities, particularly if the tube has to be moved in its transverse direction, i.e. perpendicularly in relation to the transport direction of the hollow blank in the pilger rolling mill. Other transport devices are, for example, oblique ramps, on which the tube can roll off in the transverse direction and thus moves in a direction perpendicular to the transport direction of the hollow blank in the pilger rolling mill.

In one embodiment of the invention, the rolling train has a parting-off unit, between the pilger rolling mill and the first buffer, for cutting the tube into lengths. In the parting-off of the tube, the latter is divided into two tube portions.

In one embodiment of the invention, an inspection device, which enables inspection of the inner wall of the tube, is provided between the pilger rolling mill and the annealing furnace, preferably between the pilger rolling mill and the parting-off unit for cutting the tube into lengths. In one embodiment, such an inspection device is an eddy-current probe that, on a delivery arm, can be inserted into and removed from the tube.

In one embodiment, in which the inspection device is provided between the pilger roving mill and the parting-off unit, it is possible to cut out from the tube, by means of the parting-off unit, tube portions that have failed the inspection, and to perform further processing only on those tube portions that have passed the inspection.

In one embodiment, the rolling train has a device for degreasing a tube outer wall, between the pilger rolling mill and the first buffer, preferably between the pilger rolling mill and a parting-off unit for cutting the tube into lengths.

In a further embodiment, a device for degreasing a tube inner wall is provided between the pilger rolling mill and the first buffer, preferably between a parting-off unit for cutting the tube into lengths and the first buffer.

In one embodiment, the straightening machine is an oblique-roller straightening machine.

It is understood that, in embodiments of the invention, further processing devices, for executing further processing steps for the ready tube portions, may be disposed after the straightening machine. Such further processing devices are, for example, a device for finish-cutting the tubes, an inspection device or a device for packaging the tubes.

Further advantages, features and application possibilities of the present invention are elucidated on the basis of the following description of an embodiment and the associated figure.

FIG. 1 shows a schematic top view of an embodiment of the rolling train according to the invention.

The rolling train shown in FIG. 1 has the following processing stations for producing a high-grade special-steel tube: a cold pilger rolling mill 1, a device for degreasing 2 of the outer wall of the tube, a parting-off device 3 for cutting the tube into lengths, a device for degreasing 4 of the tube inner wall and for processing ends of the tube, a first buffer 5 for the tubes, an annealing furnace 6, a second buffer 7 for the tubes, and a straightening machine 8.

In the rolling train the direction of flow, or transport direction, of the hollow blank, or after the cold pilger rolling mill 1 of the tube, is from the cold pilger rolling mill 1 towards the outlet of the straightening machine 8.

Disposed between the individual processing stations 1, 2, 3, 4, 6, 8 there are automated transport devices 9*a*, 9*b*, 9*c*, 9*d*, 9*e*, 9*f*, which perform the function of transporting the tube in a fully automated manner from one processing station to the next, without the need for human intervention.

These transport devices 9*a*, 9*b*, 9*c*, 9*d*, 9*e*, 9*f* are, on the one hand, the roller conveyors 9*a*, 9*b*, 9*c*, 9*d*, 9*e*, 91 shown in FIG. 1. These have rollers, on which the tube is moved, or transported, in its longitudinal direction. In the embodiment represented, in each roller conveyor every second roller 10 is provided with a motor drive, which puts the roller into a rotary motion and thus causes the tubes, lying on the rollers 10, to be transported.

As well as having the roller conveyors, the embodiment of the rolling train shown has transport devices 11, 12, 13, at three locations, which transport the tubes in their transverse direction.

In this way, it is possible to limit the overall length of the rolling train, despite the large number of processing stations 1, 3, 4, 6, 8. If the transport path, or material flow, within the rolling train is considered, the rolling train has a path fold. The transport direction of the tube in the rolling train changes three times in total. The first change of direction is effected between the degreaser 2 for the tube outer wall and the tube parting-off device 3, the second change of direction is effected between the degreaser 4 for the tube inner wall and the annealing furnace 6, and the third change of direction is effected between the annealing furnace 6 and the straightening machine 8.

The tube transport devices on the individual segments are in opposition to each other by 180°, while transport in the transverse direction of the tube, i.e. substantially perpendicular to its longitudinal direction, is effected between each of the four transport segments in the longitudinal direction.

The transport devices 11, 12, 13 for transporting the tube in the rolling train, in a transverse direction perpendicular to the transport direction of the hollow blank in the cold pilger rolling mill 1, are of entirely differing designs.

The first of these transport devices 11 consists of an oblique ramp that connects two roller conveyors. The tube that has exited the degreaser 2 rolls from an upper roller conveyor 9*a*, via an incline, on to a lower roller conveyor 9*b*.

The second transport device 12 for transporting the tube in a direction perpendicular to the transport direction of the hollow blank in the cold pilger rolling mill 1 is integrated into the buffer 5 for the tubes. The transport device 12 is a bridge crane, the bridge 14 of which can be moved, between two elevated rails 15, in a direction substantially perpendicular to the transport direction 16 of the hollow blank in the cold pilger rolling mill 1. The bridge 14 has a series of grippers (not represented), which grip a tube that has exited the roller conveyor 9*c* preceding the buffer 5.

The third transport device 13 for transporting the tube in a direction perpendicular to the first direction 22 is again a ramp, on which the tubes roll off automatically in their transverse direction.

The cold pilger rolling mill 1 consists of a rolling stand 16 comprising rollers, a calibrated rolling mandrel, and a drive 17 for the rolling stand 16. The drive for the rolling stand 16 has a push rod, a drive motor and a flywheel. A first end of the push rod is fastened to the flywheel, eccentrically in relation to the rotation axis of the drive shaft.

In the embodiment represented, the rotation axis of the motor shaft coincides with the rotation axis of the drive shaft of the flywheel. When the rotor of the drive motor rotates, a torque is developed, which is transmitted to the motor shaft connected to the rotor. The motor shaft is connected to the flywheel of the drive train in such a manner that the torque is transmitted to the flywheel. As a result of the torque, the flywheel rotates about its rotation axis. The push rod, which is disposed with its first end at a radial distance from the rotation axis, is subjected to a tangential force and transmits this to the second end of the push rod. The rolling stand 16, connected to the second end of the push rod, is moved back and forth along the travel direction 22 defined by a guide rail of the rolling stand 16.

During the process of cold pilgering on the cold pilger rolling mill 1 shown schematically in FIG. 1, a hollow blank, i.e. a blank tube, inserted in the cold pilger rolling mill 1 in the direction 22 is fed progressively in the direction towards and beyond the rolling mandrel, while the rollers of the rolling stand 16 are moved horizontally back and forth in a rotating manner, over the mandrel, and thus over the hollow blank. The horizontal motion of the rollers is defined by the rolling stand 16 itself, on which the rollers are rotatably mounted. The rolling stand 16 is moved back and forth in a direction parallel to the rolling mandrel, while the rollers themselves obtain their rotary motion by means of a toothed rack, which is fixed relative to the rolling stand 16 and in which there engage toothed wheels that are fixedly connected to the roller axles.

The feed of the hollow blank over the mandrel is effected by means of the feed clamping carriage 18, which enables a translational motion in a direction 16 parallel to the axis of the rolling mandrel. The conically calibrated rollers, disposed over one another in the rolling stand 16, rotate contrary to the feed direction 16 of the feed clamping carriage 18. The so-called pilger mouth formed by the rollers grasps the hollow blank and the rollers externally squeeze off a small wave of material, which is extended to the assigned wall thickness by the smoothing pass of the rollers and by the rolling mandrel, until the idling pass of the rollers releases the finished tube. During the rolling operation, the rolling stand 16, with the rollers attached thereto, moves contrary to the feed direction 22 of the hollow blank. The hollow blank, after attaining the idling pass of the rollers, is displaced by a further step towards the rolling mandrel, by means of the feed clamping carriage 18, while the rollers return, with the rolling stand 16, to their initial horizontal position. At the same time, the hollow blank undergoes rotation about its longitudinal axis, in order to achieve a uniform shape of the finished tube. As a result of each tube portion being rolled over multiple times, a uniform wall thickness and roundness of the tube is achieved, as well as a uniform internal and external diameter.

A central sequence control system of the rolling train controls all initially independent processing stations, thus also the drives of the cold pilger rolling mill 1 itself. The control system for the cold pilger rolling mill 1 begins with the operation of a feed step of the drive of the feed clamping carriage 18, for feeding the hollow blank. Following attainment of the feed position, the drive is controlled such that it holds the feed clamping carriage 18 static. The rotational speed of the drive motor for the rolling stand 16 is controlled such that, simultaneously with the feed step of the feed clamping carriage 18, the rolling stand 16 is brought back into its initial position, while, following completion of the feed step, the rolling stand 16 is displaced horizontally over the hollow blank, wherein the rollers again roll out the hollow blank. Upon attainment of the reversal point of the rolling stand 16, the drive of the clamping chuck is controlled in such a manner that the hollow blank is rotated about the mandrel.

Following discharge from the cold pilger rolling mill 1, the ready reduced tube is degreased on its outer wall in a degreaser 2. This process removes the grease applied as a lubricant in the cold pilger rolling mill, between the rollers of the rolling stand 16 and the hollow blank.

In the represented embodiment of the invention, the ready pilgered and externally degreased tube runs, with a portion of its length, into a funnel-shaped arrangement 23, with the result that a portion of the ready pilgered tube is inserted into a substantially vertical hole 25, in order to save space in the hall in which the rolling train is located. For the purpose of running a portion of the ready pilgered tube into the hole 25, a plurality of rollers 24 are provided, which are disposed such that their surface portions that are in engagement with the ready pilgered tube describe a curvature, along which the tube end runs into the hole 25.

Owing to the transport device 1 the tube, after the degreaser 2, undergoes an offset in a direction perpendicular to the transport direction 16 of the hollow blank in the cold pilger rolling mill 1. The further transport of the tube is effected with a 180° turn, relative to the transport direction of the hollow blank in the cold pilger rolling mill 1, into a parting-off device 3. In the parting-off process, a cutting tool is revolved around the longitudinal axis of the tube and simultaneously advanced on to and into the tube in a rotary manner, with the result that the tube is cut, and two tube portions are produced. The parting-off process may be considered as milling, since the tube is fixedly clamped in place while the parting-off cutter is revolved around the tube and advanced in a rotary manner.

The parted-off tube, i.e. cut to the set length, exits the parting-off device 3 on a roller conveyor 9*c*, and is removed from the latter, in the transverse direction, and inserted into a degreaser 4 for degreasing the inner wall of the tube. In the embodiment represented, the end faces of the tube also undergo surface milling (processing of the ends) in the degreaser 4, with the result that these end faces have a flatness such as that required for subsequent orbital welding of a plurality of tube portions to each other.

After the tube has been internally degreased and its end surfaces have been planished, it is swiveled back on to the roller conveyor 9*c* and fed by the latter into the buffer 5.

In the embodiment represented, the buffer 5 has one intake bench 19 and five storage benches 20. By means of the bridge crane 12, the tube is grasped from the intake bench 19 and deposited on one of the storage benches 20. Each subsequent tube is likewise deposited on the same storage bench 20, until there is a desired number of tubes lying on a storage bench 20, which then form a bundle, i.e. a furnace charge.

In an alternative embodiment, not represented here, the tubes of a bundle are bound together, wherein the binding together of the bundle of tubes is effected in an automated manner on the storage bench 20.

Once the bundle has been formed, the bundle is grasped by means of the bridge gripper 14 and placed on to the roller conveyor 9*d*, which delivers the bundle of tubes to the mesh belt furnace 6.

In the embodiment represented, the first buffer 5 has the possibility of extracting, from the rolling train, tubes that have been pilgered in the pilger rolling mill 1 and parted-off by the parting-off device 3, to enable them to undergo further processing, if necessary, at a later point in time and in another facility. Moreover, tubes that have been pilgered in another rolling mill can be fed into the buffer 5, in order to process them further in the furnace 6 and in the straightening machine 8.

In the furnace 6, the bundle of tubes is annealed for the purpose of hardening, i.e. brought to a temperature of 1080° C. To enable continuous production, i.e. the continuous intake of tubes into the furnace, the furnace is designed as a mesh belt furnace 6, in which a conveyor belt 21, composed of a special-steel wire mesh, as an endless belt, extends through the muffle of the furnace and moves a tube bundle continuously through the muffle. An $H_2$-flushed sluice is provided at each of the ends of the muffle. These sluices prevent oxygen from entering the muffle during operation of the furnace, which oxygen would then react with the tubes under temperature.

The annealing of the tubes in the mesh belt furnace 6 results in hardening of the special steel of the tubes. It is found to be disadvantageous, however, that the tubes become distorted because of the high temperatures in the annealing furnace 6 and, after exiting the furnace, are no longer straight but, in particular, have waves in their longitudinal extent. A final processing step is therefore still necessary, in which the tubes that have exited the furnace 6 are straightened.

The tubes are first removed from the furnace by means of a roller conveyor 9*e* and from there are moved, by means of a bridge crane (not shown in FIG. 1), in a direction perpendicular to the transport direction 16 of the hollow blank in the cold pilger rolling mill, into the second tube buffer 7. Here, the bundle in which the tubes were transported through the furnace 6 is undone, by cutting the tie wires, and the tubes are separated. Each individual tube is then inserted into the straightening machine 8, where it is straightened.

The straightening machine 8 is a so-called oblique-roller straightening machine, in this case having ten rollers. The rotation axes of the individual rollers are disposed at an angle ("oblique") in relation to the longitudinal axis of the installation, which coincides substantially with the longitudinal axis of the tube to be straightened. The individual rollers have hyperbolically shaped circumferential surfaces, with which the rollers come into engagement with the tube to be straightened. Owing to the hyperbolic shape of the circumferential surfaces of the rollers, each roller has a long surface of bearing contact on the tube to be straightened, with the result that the bending forces are passed from the rollers, as a distributed load, to the tube to be straightened.

Of the total of ten rollers of the straightening machine, each two rollers are disposed over one another in pairs, with the result that one comes into engagement from above with the tube to be straightened, and the other roller of the pair comes into engagement therewith from below. The rollers are motor-driven, and the alignment of their rotation axes, at an angle in relation to the axis of the tube to be straightened, causes a rotary motion and a feed motion to be imposed upon the tube to be straightened. The lower roller of a pair bends the tube plastically into the concave contour of the upper roller. This plastic longitudinal bending is superimposed by a plastic oval deformation of the tube cross section, whereby the straightness, particularly at the tube ends, is further improved. The transport path of the tube to be straightened in the straightening machine 8 is delimited by guide plates or guide edges extending in the longitudinal direction.

Provided after the straightening machine 8, in the embodiment represented, is a device for planishing, in which two rotating fleece discs 26 come into frictional engagement with the finished tube to effect polishing.

For purposes of original disclosure, it is pointed out that all features that may be inferred by a person skilled in the art from the present description, the drawings and the claims, even if they have been specifically described only in connection with certain other features, can be combined, both singly and in any combinations, with others of the features or feature groups disclosed here, provided that this has not been expressly precluded, or that such combinations are not rendered impossible or meaningless by technical facts. It is only for reasons of brevity and readability of the description that all conceivable feature combinations are not presented comprehensively and explicitly here. While the invention has been presented and described in detail in the drawings and the preceding description, this presentation and description are merely exemplary, and not conceived as a limitation of the protective scope, as is defined by the claims. The invention is not limited to the disclosed embodiments.

For a person skilled in the art, modifications of the disclosed embodiments are evident from the drawings, the description and the accompanying claims. In the claims, the term "have" does not preclude other elements or steps, and the indefinite article "a" or "an" does not preclude a plurality. The mere fact that certain features are claimed in different claims does not preclude their combination. References in the claims are not conceived as a limitation of the protective scope.

LIST OF REFERENCES

1 cold pilger rolling mill
2, 4 degreaser
3 parting-off device
5 first buffer
6 annealing furnace
7 second buffer
8 straightening machine
9*a, b, c, d, e, f* roller conveyor
10 driven roller
11, 12, 13 transport devices
14 bridge gripper
15 rails
16 rolling stand
17 drive
18 feed clamping carriage
19 intake bench
20 storage benches
21 conveyor belt
22 transport direction in the rolling mill 1
23 floor intake
24 roller
25 hole
26 fleece discs

The invention claimed is:

1. Cold rolling train for producing a tube, comprising a cold pilger rolling mill for reducing the diameter of a hollow blank to form the tube, a device for degreasing the tube outer wall, a first buffer for a plurality of tubes, wherein the first buffer has a device for bundling a plurality of tubes in a bundle, an annealing furnace for simultaneous annealing of a plurality of tubes, a second buffer for a plurality of tubes, wherein the second buffer has a device for separating the plurality of tubes out of a bundle, and a straightening machine for straightening the separated tubes in succession, wherein the devices are disposed, in a transport direction of the tube, in the aforementioned sequence, wherein an automated transport device for the tube is provided between, respectively, the pilger rolling mill, the first buffer, the annealing furnace, the second buffer and the straightening machine, wherein the cold rolling train is capable of operating continuously such that, in a charged state, the hollow blank is rolled out in the cold pilger rolling mill while, substantially simultaneously, after the straightening machine, a finished tube is removed from the cold rolling train, wherein a transport direction of the hollow blank in the pilger rolling mill defines a first direction and wherein the first buffer has a transport device for transporting the tubes in a second direction that is perpendicular to the first direction, wherein the second buffer has a transport device for transporting the tubes in a second direction that is perpendicular to the first direction, and wherein the rolling train is set up such that the tube in the rolling train is transported portionally, in a direction that is parallel but opposite to the first direction.

2. Rolling train according to claim 1, wherein the annealing furnace is a belt furnace.

3. Rolling train according to claim 1, comprising a parting-off unit for cutting the tube into lengths, between the pilger rolling mill and the first buffer.

4. Rolling train according to claim 3, comprising a device for degreasing a tube outer wall, between the pilger rolling mill and the parting-off unit for cutting the tube into lengths.

5. Rolling train according to claim 4, comprising a device for degreasing a tube inner wall, between the parting-off unit for cutting the tube into lengths and the first buffer.

6. Rolling train according to claim 3, comprising a device for degreasing a tube inner wall, between the parting-off unit for cutting the tube into lengths and the first buffer.

7. Rolling train according to claim 3, comprising an inspection device for inspecting a tube inner wall, between the pilger rolling mill and the parting-off unit for cutting the tube into lengths.

8. Rolling train according to claim 1, comprising a device for degreasing a tube outer wall, between the pilger rolling mill and the first buffer.

9. Rolling train according to claim 8, comprising a device for degreasing a tube inner wall, between the pilger rolling mill and the first buffer.

10. Rolling train according to claim 1, comprising a device for degreasing a tube outer wall, between the pilger rolling mill and the first buffer.

11. Rolling train according to claim 1, comprising a device for degreasing a tube inner wall, between the pilger rolling mill and the first buffer.

12. Rolling train according to claim 1, comprising an inspection device for inspecting a tube inner wall, between the pilger rolling mill and the first buffer.

13. Rolling train according to claim 1, wherein the transport direction of the tube after the second buffer is the same as the transport direction of the tube in the cold pilger rolling mill.

14. Rolling train according to claim 1, wherein the transport direction of the tube in the straightening machine is the same as the transport direction of the tube in the cold pilger rolling mill.

15. Rolling train according to claim 1, comprising an inspection device for inspecting a tube inner wall, between the pilger rolling mill and the first buffer.

16. Rolling train according to claim 1, comprising a control system, which controls all processing steps in the rolling train.

* * * * *